US005220780A

United States Patent [19]

Bert

[11] Patent Number: 5,220,780

[45] Date of Patent: Jun. 22, 1993

[54] COATED METALLIC EXPANSION BAND AND METHOD OF COATING APPLICATION

[75] Inventor: Raymond R. Bert, Cranston, R.I.

[73] Assignee: Textron, Inc., Providence, R.I.

[21] Appl. No.: 814,568

[22] Filed: Dec. 30, 1991

[51] Int. Cl.[5] ..... A44C 5/04

[52] U.S. Cl. ..... 59/79.1; 59/35.1

[58] Field of Search ..... 59/79.1, 78, 35.1

[56] References Cited

U.S. PATENT DOCUMENTS

| | | | |
|---|---|---|---|
| 2,826,900 | 3/1958 | Augenstein | 59/79.1 |
| 3,007,301 | 11/1961 | Sand | 59/79.1 |
| 3,625,001 | 12/1971 | Levinger | 59/79.1 |
| 4,723,406 | 2/1988 | Ripley | 59/79.1 |

OTHER PUBLICATIONS

"Tool Engineers Handbook", 1949, pp. 1237-1238.

*Primary Examiner*—David Jones

*Attorney, Agent, or Firm*—Samuels, Gauthier & Stevens

[57] ABSTRACT

An expansion band is provided with a row of metallic bottom links underlying a row of metallic top links. The top links are offset with respect to the bottom links in the direction of the band length, with metallic top shells mounted on the top links. Metallic spring biased connecting elements mechanically couple the top and bottom links in a manner permitting resilient longitudinal adjustment of the band between a contracted state at which the top shells are in mutual abutting relationship to thereby cover the underlying upper surfaces of the bottom links, and an extended state at which the top shells are spaced on from the other to thereby expose the upper surfaces of the bottom links. Only the top shells having a base coating of black oxide, and only the to shells having a base coating of black oxide, and only the exposed exterior surfaces of the thus coated top shells and the upper surfaces of the bottom links have a polymeric coating. Preferably, the black oxide coating is produced by immersing the top shells in a heated molten bath containing an oxidizing agent. The polymeric coating is preferably a polyurethane paint which may have a dye image subsequently applied thereto.

3 Claims, 2 Drawing Sheets

COATED METALLIC EXPANSION BAND AND METHOD OF COATING APPLICATION

BACKGROUND OF THE INVENTION

1. Field of the Invention

This invention relates generally to metallic expansion watch bands and the like, and is concerned in particular with an improvement in nonmetallic decorative coatings for such bands, as well to the method of coating application.

2. Background of the Invention

Conventional metallic expansion bands are produced with various finishes, including for example rolled gold plate (commonly referred to as "RGP"), stainless steel, and to a more limited extent, brass with a protective lacquer coating. While these finishes are entirely acceptable from a utilitarian standpoint, their monochromatic appearance can at times limit the extent to which they can satisfy the more colorful demands of modern day fashion and styling.

Efforts at achieving more varied presentations have included the combination of several conventional finishes in a single band, for example by alternating RGP and stainless steel components. In other cases, clear plastic films have been adhered to the metallic top shells by means of pigmented bonding agents or adhesives. Painting techniques also have been employed. However, in the case of expansion bands, the application of paint has been selectively limited to recessed surfaces, where chipping, scratching and abrasion is less likely to occur.

An object of the present invention is to provide improved colored coatings for the top shells of metallic expansion watch bands. The coatings of the present invention have improved resistance to chipping, scratching and abrasion and can thus be applied to all exposed areas of the top shells, including both recessed and non-recessed surfaces.

SUMMARY OF THE INVENTION

According to the present invention, an expansion band is provided with a row of metallic bottom links underlying a row of metallic top links. The top links are offset with respect to the bottom links in the direction of the band length, with metallic top shells mounted on the top links. Metallic spring biased connecting elements mechanically couple the top and bottom links in a manner permitting resilient longitudinal adjustment of the band between a contracted state at which the top shells are in mutual abutting relationship to thereby cover the underlying upper surfaces of the bottom links, and an extended state at which the top shells are spaced one from the other to thereby expose the upper surfaces of the bottom links. Only the top shells having a base coating of black oxide, and only the exposed exterior surfaces of the thus coated top shells and the upper surfaces of the bottom links have a polymeric coating.

Preferably, the black oxide coating is produced by immersing the top shells in a heated molten bath containing an oxidizing agent. The polymeric coating is preferably a polyurethane paint which may have a dye image subsequently applied thereto.

The method of the present invention involves the steps of:

a) applying the base coating of black oxide to the top shells prior to mounting the top shells on the top links;

b) mounting the top shells on the top links;

c) longitudinally adjusting the band to its extended state; and d) applying the polymeric coating to the exposed surfaces of the top shells and the exposed upper surfaces of the bottom links.

The invention will now be described, by way of example only, with reference to the accompanying drawings, wherein:

DETAILED DESCRIPTION OF ILLUSTRATED EMBODIMENT

Figure 1:
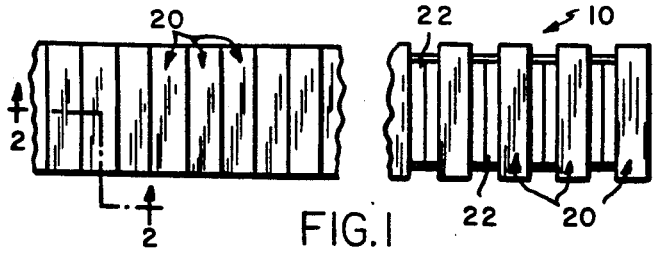
FIG. 1 is a partial top plan view of an expansion band according to the present invention, with the left-hand portion of the band being shown in its contracted state and with the right-hand portion of the band being shown in its extended state.
Figure 2:
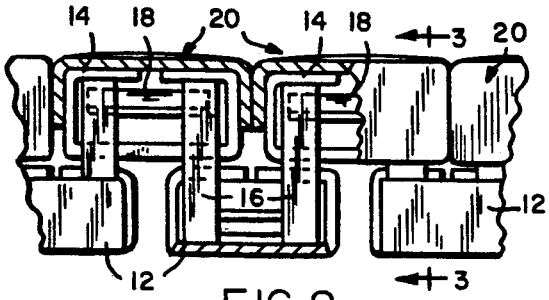
FIG. 2 is a sectional view on an enlarged scale taken generally along line 2—2 of FIG. 1.
Figure 3:
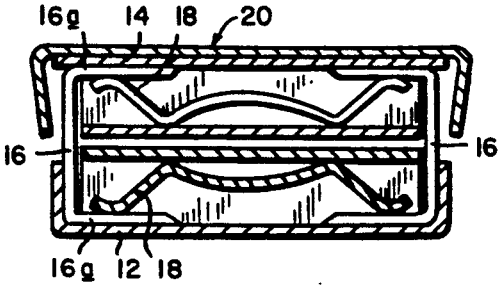
FIG. 3 is a sectional view taken generally along line 3—3 of FIG. 2.
Figure 4:
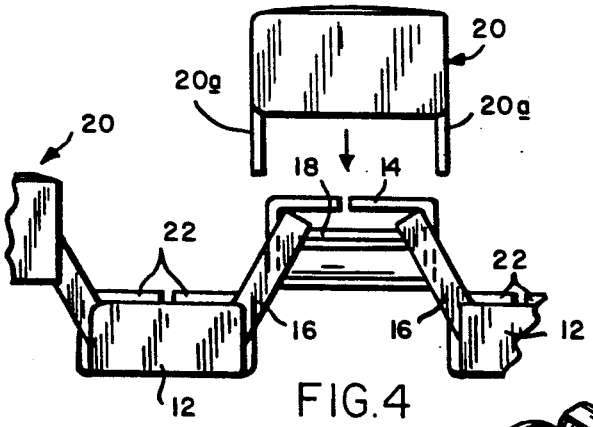
FIG. 4 is a side view, on an enlarged scale, of the extended portion of the band shown in FIG. 1, with one of the top shells shown removed from its respective top link.
Figure 5:
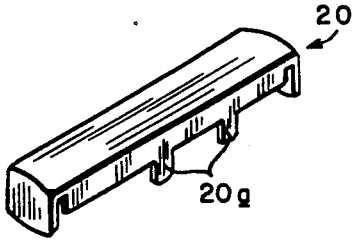
FIG. 5 is a perspective view of a typical top shell.

In accordance With the present invention, a flexible longitudinally extending expansion band is shown at 10. The band has a row of metallic bottom links 12 underlying a row of metallic top links 14. The bottom and top links 12, 14 are generally of a box-like configuration. The top links 14 are offset in the direction of the band length with respect to the bottom links 12. U-shaped staples 16 have their legs **16*a* received in the ends of the bottom and top links 12, 14 to provide a mechanical coupling therebetween. The staple legs 16*a* are acted upon by resilient leaf springs 18 housed in the bottom and top links. Metallic top shells 20 are mounted on the top links 14 by means of bendable tabs 20*a* (see FIG. 5). The springs 18 coact with the staples 16 in a manner permitting resilient longitudinal adjustment of the band between a contracted state (FIG. 2 and the left-hand portion of FIG. 1) and an extended state (FIG. 4 and the right hand portion of FIG. 1). In the extended state, the top shells 20 are spaced one from the other to expose the upper surfaces 22 of the bottom links 12, whereas in the contracted state, the top shells abut one another to cover the surfaces 22. The bottom and top links 12, 14, the top shells 20, and the staples 16 and springs 18** are typically fabricated as stampings from 300 Series stainless steel sheet stock.

Figure 8A:
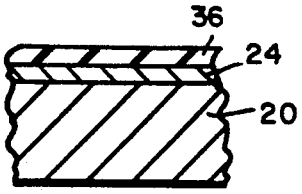
FIGS. 8A and 8B are enlarged cross sectional views showing different surface treatments at different areas of the band.
Figure 9:
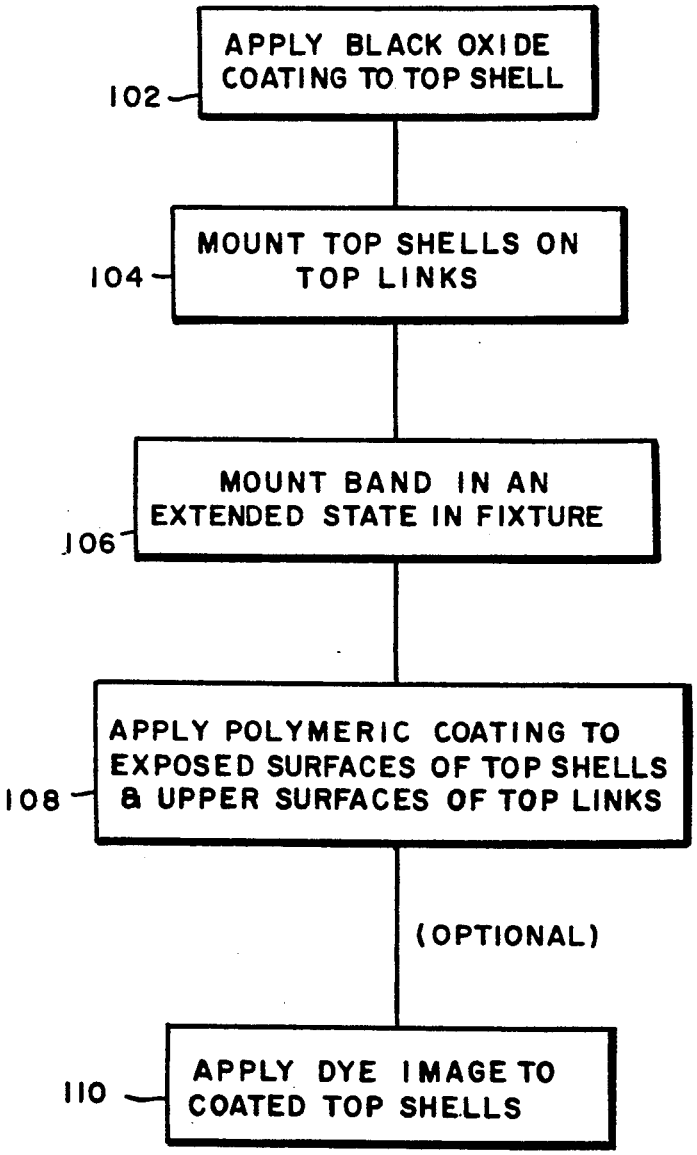
FIG. 9 is a block diagram depicting the method of applying various coatings to the band.

With reference to FIGS. 8A and 9, the first step in the coating method of the present invention (function block 102) entails applying a black oxide coating 24 to the top shells 20. This is accomplished by immersing the top shells in a heated molten bath containing an oxidizing agent. The process is typically referred to as "fuzed salt oxidizing", the chemicals being $Na_2Cr_2O_7$ and/or $K_2Cr_2O_7$ and the bath being at a temperature of about 750°-850° F. (399°-454° C.). At these elevated temperature, the resilience of the springs 18 would be adversely affected. Thus, the top shells are processed separately from the remaining band assembly, and are thereafter mounted on the top links (function block 104).

Figure 6:
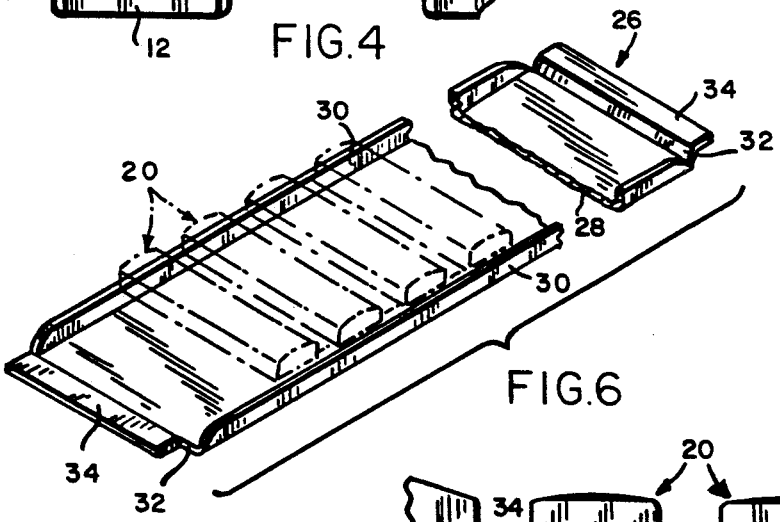
FIG. 6 is a perspective foreshortened view of a fixture used when applying the polymeric coating of the present invention.
Figure 7:
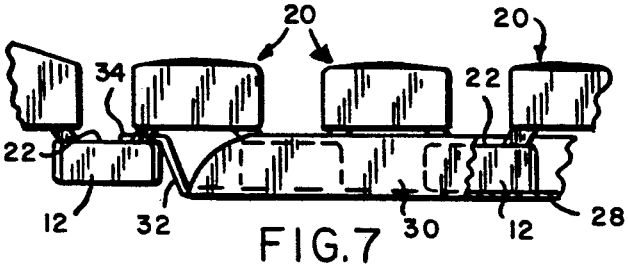
FIG. 7 is a partial side view on an enlarged scale of the fixture shown in FIG. 6, with a side wall partially broken away.

The band is next mounted in a fixture 26 (function block 106). As can be best seen in FIGS. 6 and 7, the fixture is channel-shaped in cross-sectional configuration, with a bottom 28 and side walls 30. The fixture is further provided with end walls 32 having horizontally extending flanges 34. The flanges 34 are designed for insertion between bottom and top links 12, 14 adjacent the band ends, with the length of the fixture between the flanges being such that the band is maintained in an extended state, with the upper surfaces 22 of the bottom links 12 being exposed via spaces between the top shells 20, and with the remaining surfaces of the bottom links 12 being masked by the bottom 28 and sides 30 of the fixture 26.

Figure 8B:
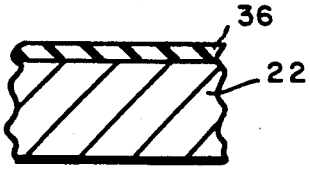

A polymeric coating 36 is then applied to the exposed surfaces of the top shells 20 as well as to the exposed upper surfaces 22 of the bottom links 12 (functional block 108). Preferably, the polymeric coating comprises a spray application of a polyurethane paint. Optionally, a dye image may then be applied to the coating on the top surfaces of the top shells (functional block 110). As shown in FIG. 8*b*, the upper surfaces 22 of the bottom links 12 will be covered with only a polymeric coating 36, whereas as shown in FIG. 8A, the exposed surfaces of the top shells 20 will have an intermediate base coating 24 of black oxide as well as a polymeric coating 36. The application of the polymeric coating 36 to the black oxide base coating 24 produces a surface which, in comparison to the same coating applied directly to untreated stainless steel (FIG. 8B), has far greater resistance to abrasion, scratching and chipping. Thus, the coated surfaces of the top shells 20 need not be recessed or otherwise protected, and in fact can even be convex, as depicted in the drawings. The polymeric coating should preferably be polyester-based when optionally applying a dye image.

Although the coating on the upper surfaces 22 of the bottom links is less resistant to damage, this is of little import since these areas are recessed below and between the top shells.

Expansion bands coated in accordance with the present invention are thus resistant to abrasion, scratching and chipping. The coatings can take on an almost limitless range of colors and patterns, thus allowing wide latitudes of design variation.

I claim:

1. In a flexible longitudinally extending expansion band having a row of metallic bottom links underlying a row of metallic top links, the top links being offset in the direction of the band length with respect to the bottom links, with metallic top shells mounted on the top links, and with metallic spring biased connecting means mechanically coupling the top and bottom links in a manner permitting resilient longitudinal adjustment of the band between a contracted state at which the top shells are in mutual abutting relationship to thereby cover upper surfaces of the bottom links, and an extended state in which the top shells are spaced one from the other to thereby expose said upper surfaces, the improvement comprising: only said top shells having a base coating of black oxide, and only exposed exterior surfaces of the thus coated top shells and the upper surfaces of said bottom links having a polymeric coating, the remaining exposed surfaces of said bottom link other than said upper surfaces being free of said black oxide coating and said polymeric coating.

2. The expansion band of claim 1 wherein said polymeric coating is a polyurethane paint.

3. The expansion band of claims 1 or 2 wherein the polymeric coating on said top shells has a dye image applied thereto.

* * * * *